US007448863B2

(12) United States Patent
Yang

(10) Patent No.: US 7,448,863 B2
(45) Date of Patent: Nov. 11, 2008

(54) ICE-CARVING MACHINE

(76) Inventor: Wu Chang Yang, 6fl., No. 40, liancheng rd., zhonghe city, taipei county (TW)

( * ) Notice: Subject to any disclaimer, the term of this patent is extended or adjusted under 35 U.S.C. 154(b) by 0 days.

(21) Appl. No.: 11/683,422

(22) Filed: Mar. 7, 2007

(65) Prior Publication Data

US 2008/0216677 A1 Sep. 11, 2008

(51) Int. Cl.
*F25C 5/00* (2006.01)
*F25C 5/14* (2006.01)

(52) U.S. Cl. ..... 425/298; 83/915.3; 425/153; 425/235; 425/288; 425/289; 425/306

(58) Field of Classification Search ..... 83/915.3; 425/298, 299, DIG. 48, 397, 450; 264/153; 156/500; *F25C 5/10, 5/14*
See application file for complete search history.

(56) References Cited

U.S. PATENT DOCUMENTS 3,905,741 A * 9/1975 Poncet ..... 425/450.1
5,056,321 A * 10/1991 Patrick ..... 62/73
5,844,210 A * 12/1998 Dowdle ..... 219/523
2003/0034118 A1* 2/2003 Alawadi et al. ..... 156/221
2004/0206250 A1* 10/2004 Kondou et al. ..... 99/426

* cited by examiner

*Primary Examiner*—Christina Johnson
*Assistant Examiner*—Magali P Théodore
(74) *Attorney, Agent, or Firm*—Banger Shia

(57) ABSTRACT

An ice-carving machine comprises a framework, an ice block positioning system, at least one feeding system, and at least one heating mold. The ice block positioning system is fixed on the workbench of the framework for positioning the ice block to be processed. The feeding system drives the heating mold to heat and press the ice block in a mold cavity with a predetermined shape. By the pressure and heat of the heating mold, the ice block is made into the shape identical to the shape of the mold cavity, thus simplifying the process of carving ice blocks, and also saving carving time and cost, being especially suitable for a mass production of ice sculptures.

7 Claims, 7 Drawing Sheets

ICE-CARVING MACHINE

BACKGROUND OF THE INVENTION

1. Field of the Invention

The present invention relates to an ice-carving machine that can simplify the process of carving ice blocks, and also save carving time and cost, is especially suitable for a mass production of ice sculptures.

2. Description of the Prior Art

With the increased need for decoration, more and more ice sculptures are popularly used in all kinds of occasions and ceremonies. In addition, many drinks are decorated with an ice block in a certain shape in order to have a better price. The ice block with a certain shape is in great demand in market. But the problems are that:

Firstly, each ice sculpture has to be carved by an experienced worker, and the production should be prevented from thawing. Ceremonies and other occasions usually need a great many ice sculptures, and the time-cost and labor-cost ice producing method is unsuitable for mass production.

Secondly, the skill to carve ice is difficult to learn in a short time, so each ice sculpture has to be carved by an experienced worker. Although the sculptures can be used for decoration, they are likely to thaw, and it is difficult to find a skilled worker, so that the cost for producing ice sculptures are too high.

Thirdly, the need for mass production of ice blocks grows rapidly, but except for using molds, it is hard to find a producing technique after producing ice blocks.

The present invention has arisen to mitigate and/or obviate the afore-described disadvantages.

SUMMARY OF THE INVENTION

The primary objective of the present invention is to provide an ice-carving machine that can simplify the process of carving ice block, and also save carving time and cost.

In order to achieve the abovementioned objective, the present invention comprises a framework, an ice block positioning system, at least one feeding system, and at least one heating mold. The ice block positioning system is fixed on the workbench of the framework for positioning the ice block to be processed. The feeding system drives the heating mold to heat and press the ice block in a mold cavity with a predetermined shape. By the press and heat of the heating mold, the ice block is made into the shape identical to the shape of the mold cavity, thus simplifying the process of carving ice block, and also saving carving time and cost, being especially suitable for a mass production of ice sculptures.

It is noted that the ice-positioning system clamps ice blocks through the plurality of pressure cylinders cooperating with the framework, and a nail plate can insert in the front end of each pressure cylinder for positioning ice blocks.

The feeding system of the present invention can utilize air pressure, liquid pressure or oil pressure. The positioning seat guides a plurality of guiding shaft to push or pull the heating mold, so as to insure the stability and the even distribution of force in the operation.

Moreover, the heating mold is made of thermal conductive materials and can be fixed with electrothermal members or a liquid heating pipe. The electrothermal members can be made into different shapes according to the heating molds such as stick-shaped, block-shaped, needle-shaped or board-shaped.

In addition, the heating molds can be provided with a temperature inductive system. During the course of heating and pressing, the heating molds are likely to be affected by the temperature of the ice blocks and cannot work normally, the temperature inductive system will cooperate with a controlling system to increase the power of the electrothermal members of the heating molds or the liquid heating pipe, in order to insure the processing efficiency.

DETAILED DESCRIPTION OF THE PREFERRED EMBODIMENTS

Figure 1:
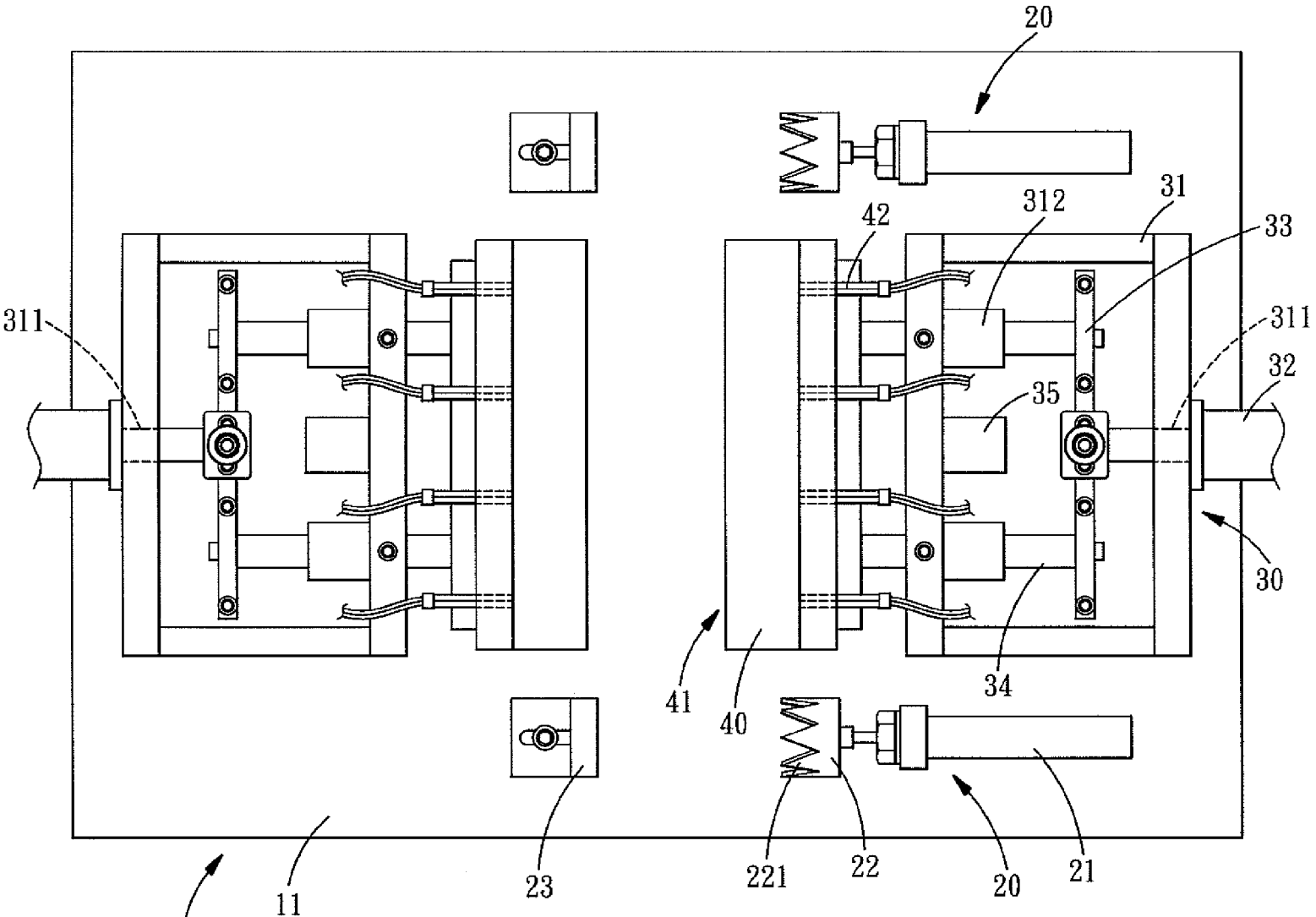
FIG. 1 is a perspective view of the structure of an ice-carving machine in accordance with the present invention.

The present invention will be more clear from the following description when viewed together with the accompanying drawings, which show, for purpose of illustrations only, the preferred embodiment in accordance with the present invention.

Referring to FIGS. 1-5, an ice-carving machine in accordance with the present invention comprises a framework 10, two ice block positioning systems 20, two feeding systems 30 and two heating molds 40.

The framework 10 is provided with hydraulic pressure power. The underside of the framework 10 is connected with a flume (not shown) and a workbench 11.

Each of the ice block positioning systems 20 includes a plurality of pressure cylinders 21, nail plates 22 and stop plates 23. The stop plates 23 are fixed on the workbench 11 of the framework 10. Each of the nail plates 22 is fixed at the front end of a working shaft of each pressure cylinder 21. The pressure cylinders 21 are fixed on the workbench 11 of the framework 10, and the nail portion 221 of each nail plate faces each stop plate. The feeding direction of the working shaft of each pressure cylinder 21 is in the direction of the stop plates 23, so that an ice block X to be processed is positioned between the nail plate 22 and the stop plate 23 of the ice block positioning system 20.

The two feeding systems 30 are assembled opposite to each other. Each feeding system 30 includes a positioning seat 31, a pressure cylinder 32, a guiding board 33 and a guiding shaft 34. The positioning seat 31 is located on the workbench 11 of the framework 10. The pressure cylinder 32 is positioned on the positioning seat 31, and a working shaft of the pressure cylinder 32 stretches or contracts under the guiding of a guiding hole 311 of the positioning seat 31. The front end of the working shaft of the pressure cylinder 32 drives the guiding board 33. On the guiding board are fixed a plurality of guiding shafts 34, and each guiding shaft 34 stretches outwards under the guiding of a guiding pipe 312 of the positioning seat 31. On the positioning seat 31 is disposed a stopping member 35 that is located opposite the guiding board 33 for controlling the feeding travel of the guiding shaft 34. In addition, the shape and size of the stopping member 35 can be changed or adjusted as required.

The heating molds 40 are fixed on the guiding shafts 34 of the feeding systems 30 respectively. A mold cavity 41 with a predetermined shape is formed in one side of each heating mold 40 facing the ice block X. The heating molds 40 are made of thermal conductive materials. A plurality of electrothermal members is buried in the heating molds 40 and can be made into different shapes according to the mold cavities 41, such as stick-shaped, block-shaped, needle-shaped or board-shaped. The mold cavities 41 of the two heating molds 40 can be fitted together.

The abovementioned is the structure and the location of each subassembly, and the following is an illustration of the operation of the present invention.

Figure 3:
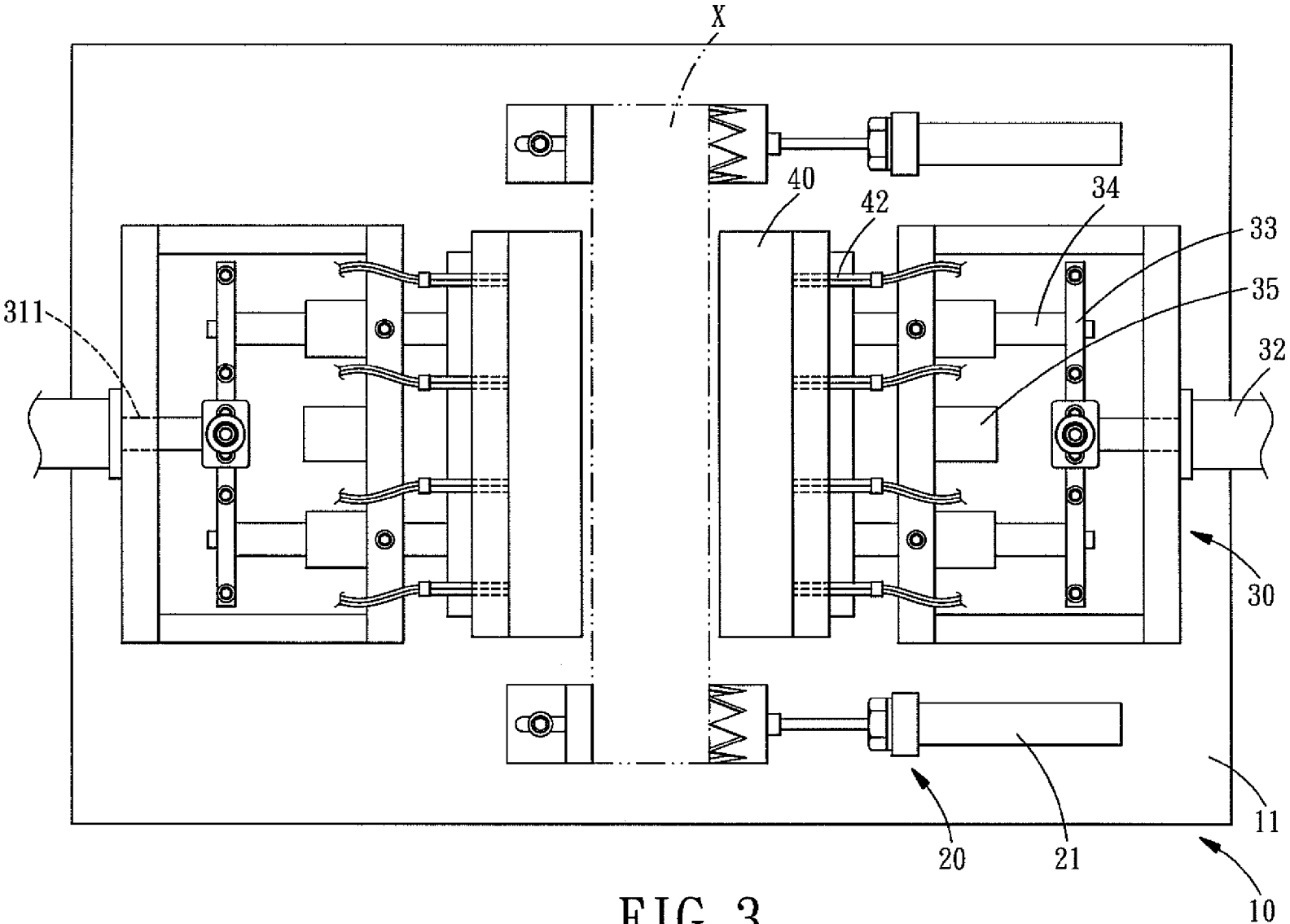
FIG. 3 is a perspective view of showing that ice-carving machine in accordance with the present invention clamps the ice block.
Figure 4:
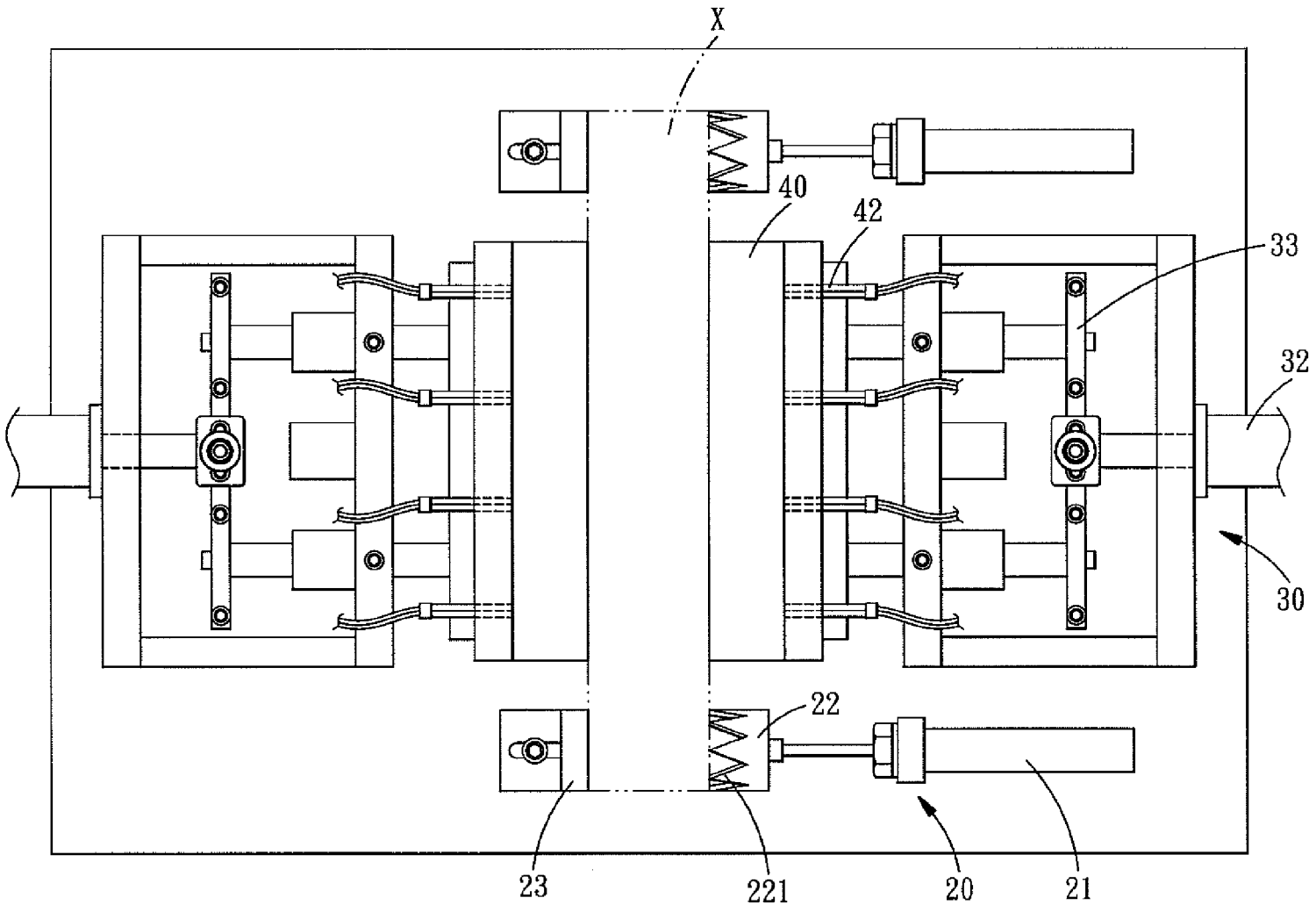
FIG. 4 is a perspective view of showing the heating and pressing status of the heating mold in accordance with the present invention.
Figure 5:
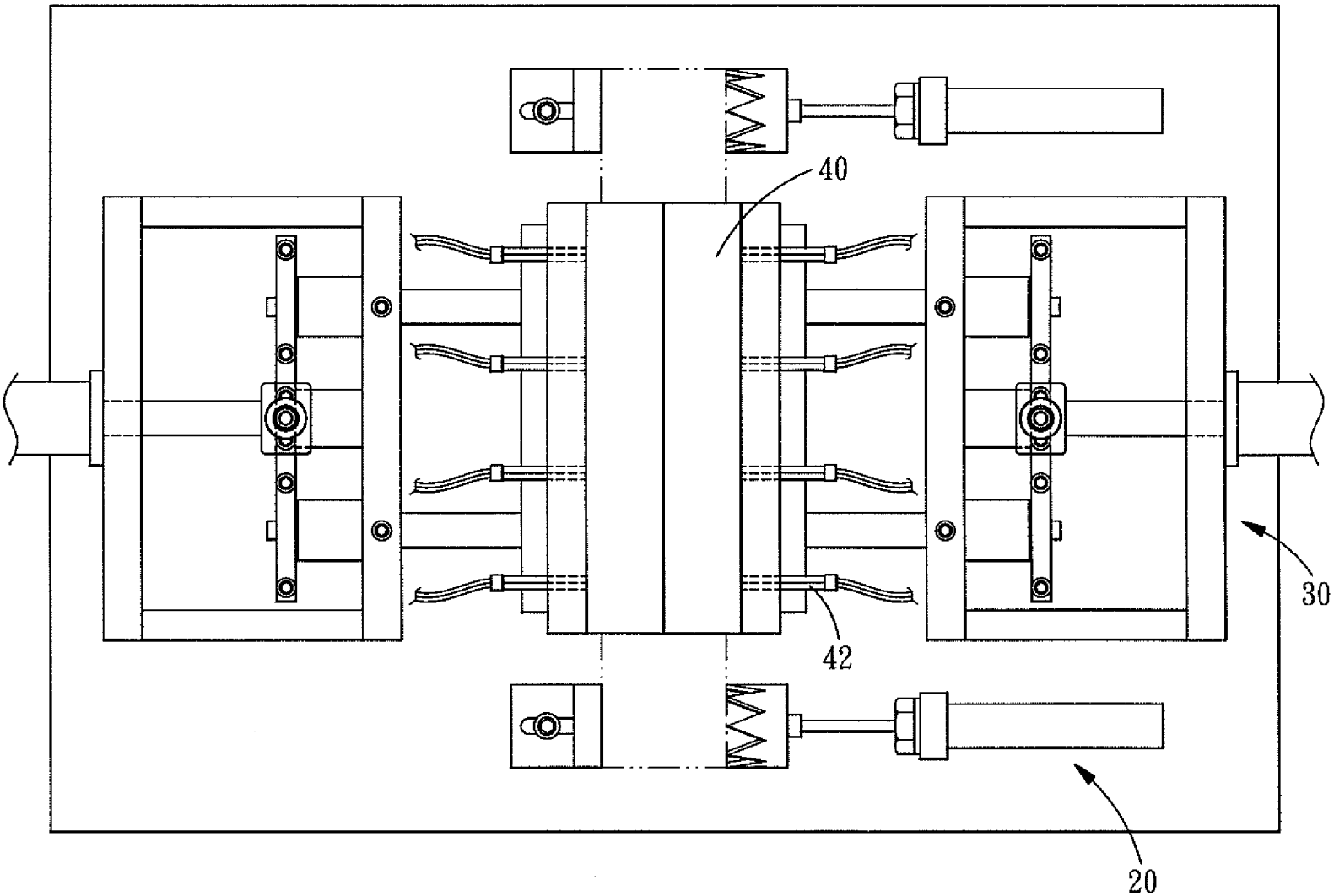
FIG. 5 is a perspective view of showing that the heating mold finishes processing.

Referring to FIGS. 3-5, the nail portion 221 of the nail plate 22 of the ice block positioning system 20 can move toward the stop plate 23 to clamp the ice block X, so that the ice block is positioned between the nail plate 22 and the stop plate 23.

At the same time, the feeding system 30 utilizes the working shaft of the pressure cylinder 32 to contract and stretch under the guiding of a guiding hole 311 of the positioning seat 31, and the working shaft of the pressure cylinder 32 drives the guiding board 33 to move, and then the guiding board 33 moves the heating molds 40.

Figure 2:
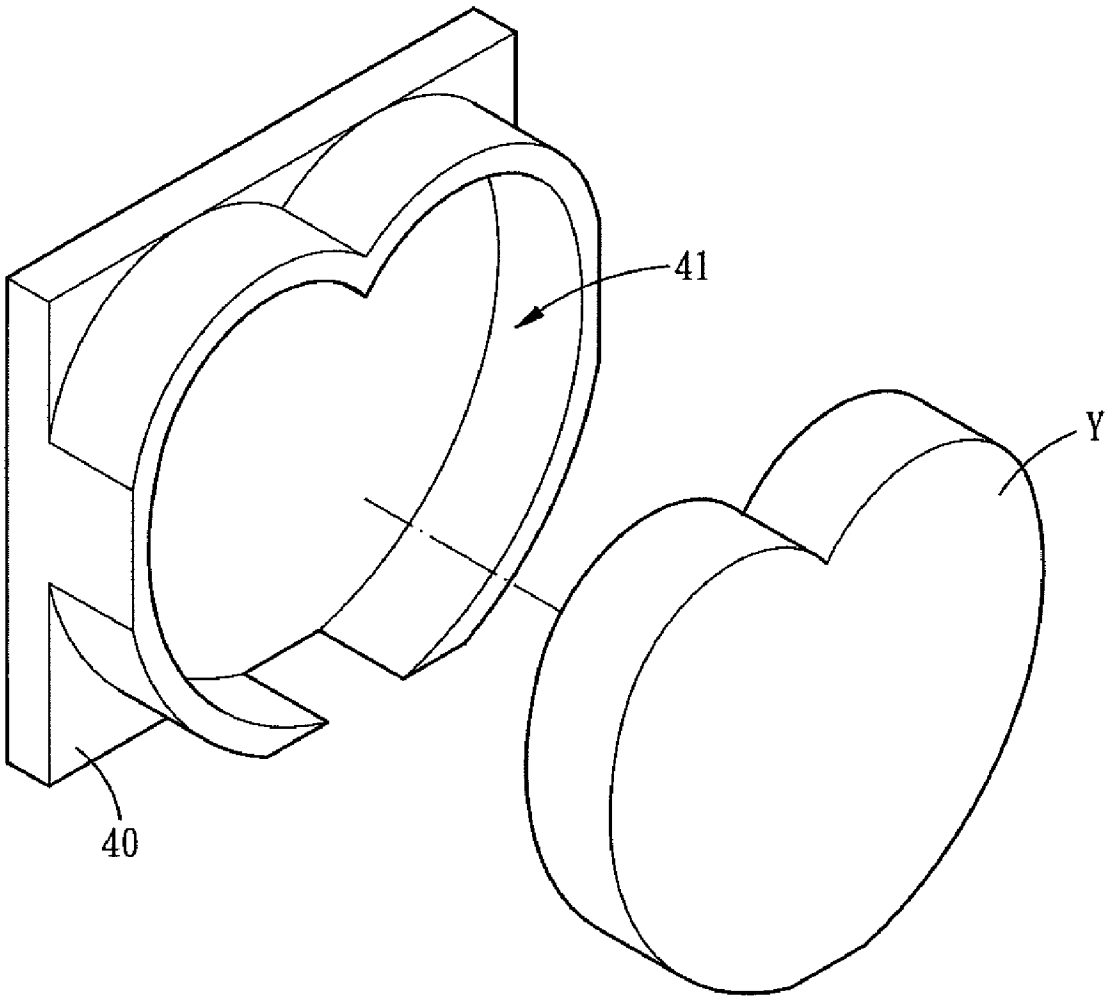
FIG. 2 is a perspective view of a heating mold and the carved ice block in accordance with the present invention.

The heating molds 40 are made of thermal conductive materials and can be heated to a high temperature very quickly by the electrothermal members. When the two heating molds 40 contacts the ice block X, the ice block X starts to thaw immediately, and the pressure of the feeding system 30 will accelerate the thawing speed. When the two heating molds 40 are fitted together, the ice block X will be converted into the ice block Y of another shape, as shown in FIG. 2. By such arrangements, the present invention can quickly produce a large amount of ice sculptures and ice blocks of different shapes. The pressure and heat of the heating molds 40 can change the shape of the ice block X into the shape of the mold cavity 41, thus simplifying the process of carving ice blocks, and also saving carving time and cost, being especially suitable for a mass production of ice sculptures.

Figure 6:
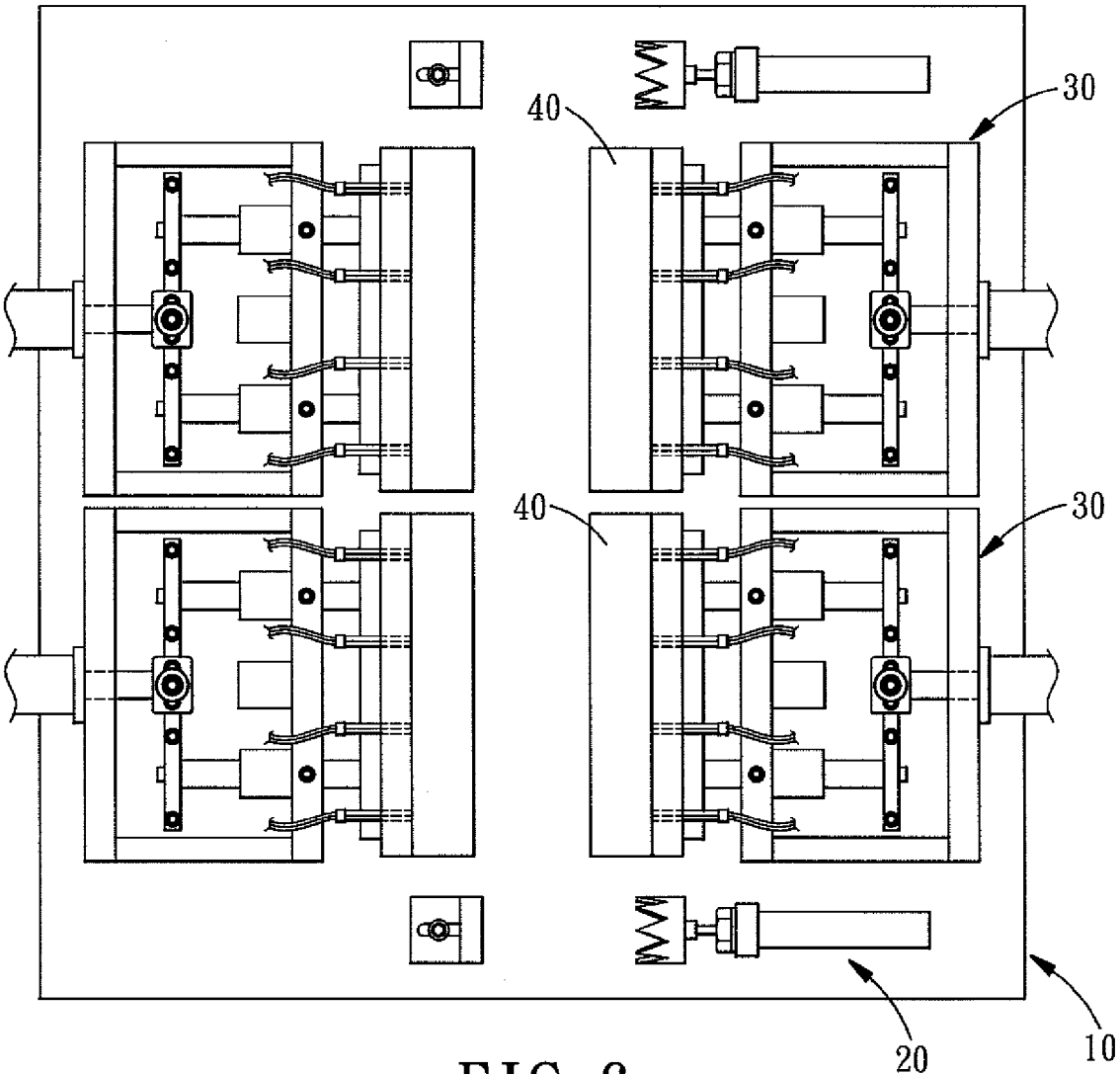
FIG. 6 is a perspective view of showing that several pairs of heating molds and feeding systems in accordance with the present invention are being used.

It is noted that the ice-carving machine of the present invention can be provided with an ice block positioning system, a feeding system and a heating mold, or can be equipped with two ice block positioning systems, two feeding systems and two heating molds on a same workbench, or even several pairs of ice block positioning systems, feeding systems and heating molds, as shown in FIG. 6. Moreover, in the heating molds can be disposed a plurality of electrothermal members or conventional heating members like a liquid heating pipe. The electrothermal members can be made into different shapes according to the heating molds such as stick-shaped, block-shaped, needle-shaped or board-shaped.

Figure 7:
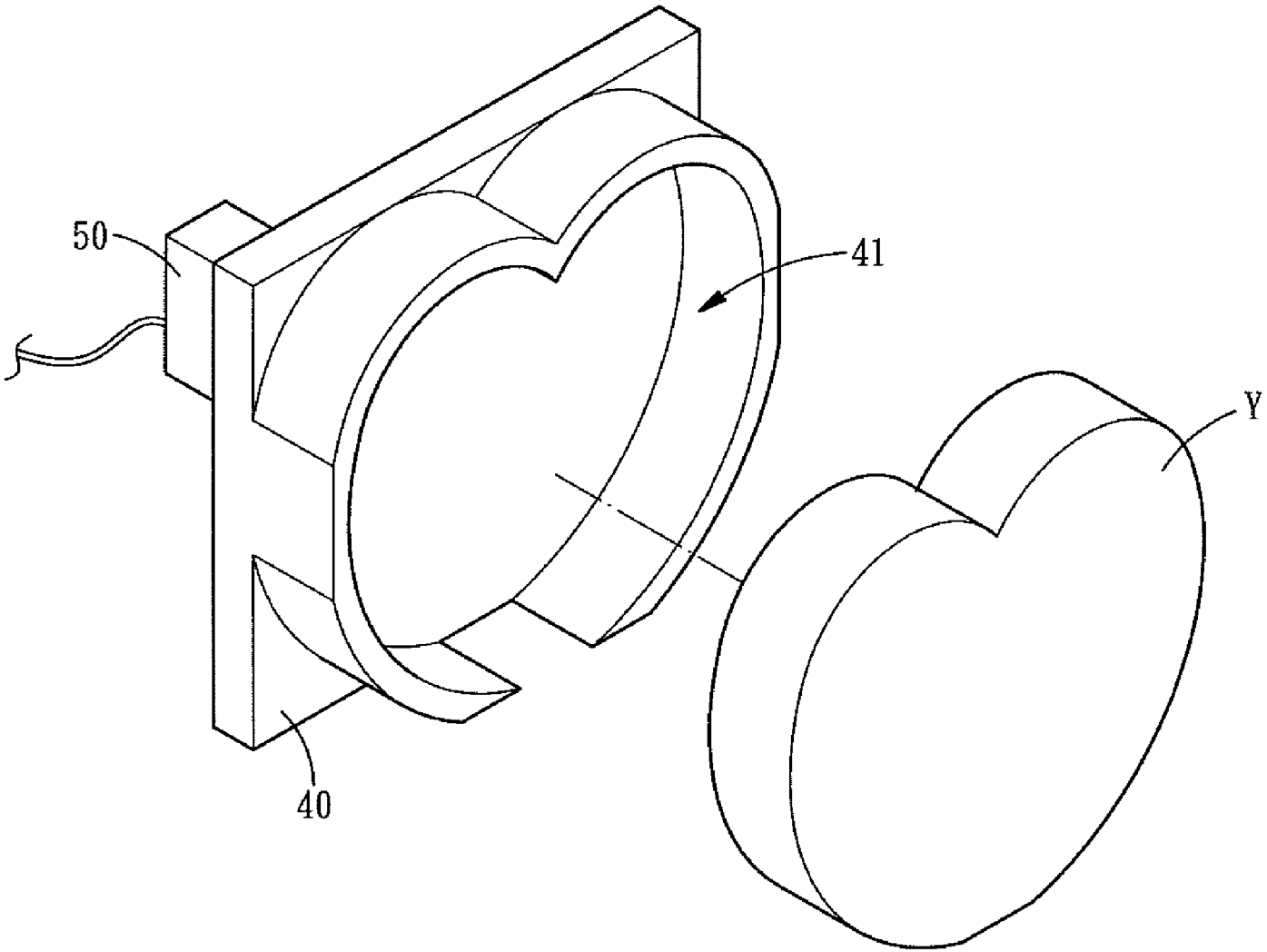
FIG. 7 is a perspective view of showing that the ice-carving machine in accordance with the present invention is equipped with a temperature inductive system.

Referring to FIG. 7, the heating molds 40 can be provided with a temperature inductive system 50. During the course of heating and pressing, the heating molds 40 are likely to be affected by the temperature of the ice block Y and cannot work normally, the temperature inductive system 50 can inform the staff, or use a controlling system (not shown) of the framework 10 to increase the power of the electrothermal members 42 of the heating molds 40 (or to use liquid heating pipe to increase power), in order to insure the processing efficiency.

To sum up, the present invention comprises a framework, an ice block positioning system, at least one feeding system and at least one heating mold. The ice block positioning system is fixed on the workbench of the framework for positioning an ice block to be processed. The feeding system drives the heating mold to heat and press the ice block in a predetermined mold cavity. By the pressure and heat of the heating mold, the ice block is made into the shape identical to the shape of the mold cavity, thus simplifying the process of carving ice blocks, and also saving carving time and cost, being especially suitable for a mass production of ice sculptures.

While we have shown and described various embodiments in accordance with the present invention, it is clear to those skilled in the art that further embodiments may be made without departing from the scope of the present invention.

What is claimed is:

1. An ice-carving machine, comprising: a framework, at least one ice block positioning system, at least one feeding system, and at least one heating mold, wherein:

the framework is provided with a workbench;

the ice block positioning system is fixed on the workbench of the framework for positioning an ice block to be processed; and the feeding system drives the heating mold to move, and the heating mold is provided with mold cavity to press and heat the ice block, so that the ice block is made into a shape identical to the shape of the mold cavity;

the ice block positioning system includes a plurality of pressure cylinders, nail plates and stop plates, the stop plates are fixed on the workbench of the framework, each of the nail plates is fixed at a front end of a working shaft of each pressure cylinder, the pressure cylinders are fixed on the workbench of the framework, and a nail portion of each nail plate faces each stop plate, a feeding direction of the working shaft of each pressure cylinder is in the direction of the stop plates, so that the ice block to be processed is positioned between the nail plate and the stop plate of the ice block positioning system.

2. The ice-carving machine as claimed in claim 1, wherein:

an underside of the framework is connected with a flume;

two feeding systems are assembled opposite to each other and each includes a positioning seat, a pressure cylinder, a guiding board and a guiding shaft, the positioning seat is located on the workbench of the framework, the pressure cylinder is positioned on the positioning seat, and a working shaft of the pressure cylinder stretches or contracts under the guiding of a guiding hole of the positioning seat, and a front end of the working shaft of the pressure cylinder drives the guiding board, and on the guiding board are fixed a plurality of guiding shafts, and each guiding shaft stretches outwards under the guiding of a guiding pipe of the positioning seat; and the heating mold is fixed on the guiding shafts of the feeding systems, respectively, and the mold cavity of the heating mold is fitted together.

3. The ice-carving machine as claimed in claim 2, wherein a mold cavity with a predetermined shape is formed in one side of each heating mold facing the ice block, and the heating molds are made of thermal conductive materials, and a plurality of electrothermal members is buried in the heating mold.

4. The ice-carving machine as claimed in claim 3, wherein the electrothermal members of the heating mold are made into stick-shaped, block-shaped, needle-shaped or board-shaped according to the shape of the mold cavities.

5. The ice-carving machine as claimed in claim 2, wherein a mold cavity with a predetermined shape is formed in one side of each heating mold facing the ice block, and the heating molds are made of thermal conductive materials, and a liquid heating pipe is buried in the heating molds.

6. The ice-carving machine as claimed in claim 5, wherein the liquid heating pipe is shaped in accordance with the shape of the heating molds.

7. The ice-carving machine as claimed in claim 2, wherein a stopping member is fixed on the positioning seat and located opposite the guiding board, and is replaceable.

* * * * *